United States Patent [19]

Goodman

[11] Patent Number: 4,954,378

[45] Date of Patent: Sep. 4, 1990

[54] REPAIR KIT FOR SHOWER CURTAIN AND THE LIKE

[76] Inventor: Allan L. Goodman, 685 Wedgewood Rd., Bethlehem, Pa. 18017

[21] Appl. No.: 272,941

[22] Filed: Nov. 18, 1988

[51] Int. Cl.[5] ..... B32B 1/04

[52] U.S. Cl. ..... 428/63; 428/65; 428/137

[58] Field of Search ..... 428/65, 137, 63; 160/DIG. 6; 24/461, DIG. 11; 402/79

[56] References Cited

U.S. PATENT DOCUMENTS

| | | | |
|---|---|---|---|
| 1,479,037 | 1/1924 | Franke | 428/65 |
| 1,869,385 | 8/1932 | Maish . | |
| 1,871,571 | 8/1932 | Weber | 428/137 |
| 2,596,179 | 5/1952 | Seymour . | |
| 2,601,125 | 6/1952 | O'Connor . | |
| 2,601,853 | 7/1952 | Hirszson . | |
| 2,681,877 | 6/1954 | Seymour . | |
| 2,764,501 | 9/1956 | Perri . | |
| 2,831,538 | 4/1958 | Lishman . | |
| 2,855,040 | 10/1958 | Gaines . | |
| 3,321,781 | 5/1967 | Reich . | |
| 4,143,767 | 3/1979 | MacDonald . | |
| 4,431,325 | 2/1984 | Colby . | |
| 4,525,399 | 6/1985 | Fields . | |
| 4,662,770 | 5/1987 | Block . | |
| 4,765,859 | 8/1988 | Heath et al. | 428/65 |

*Primary Examiner*—Alexander S. Thomas
*Attorney, Agent, or Firm*—Sanford J. Piltch

[57] ABSTRACT

A reinforcing means for repairing tears in plasticized sheet material for shower curtains and liners, bath curtains, and the like comprising an elastomeric material, manipulatable as a unit, for insertion through an aperture in the sheet material adjacent a tear for adhering to each side of the sheet material around the aperture to repair and reinforce the sheet material.

8 Claims, 3 Drawing Sheets

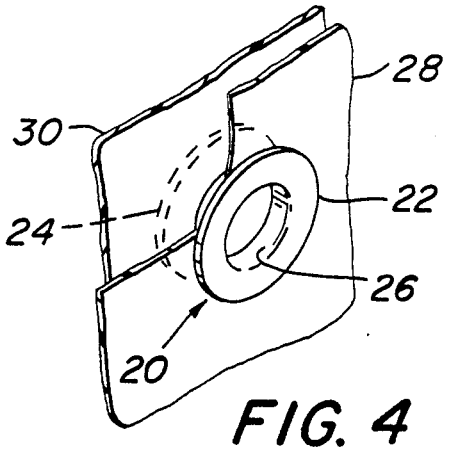
FIG. 4
FIG. 5
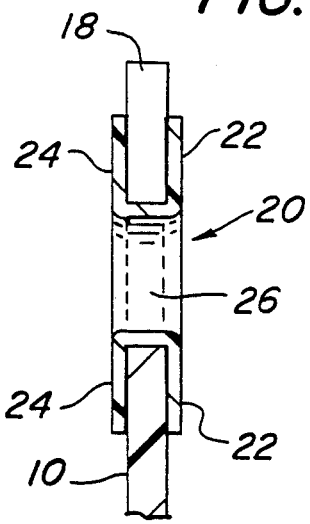
FIG. 6
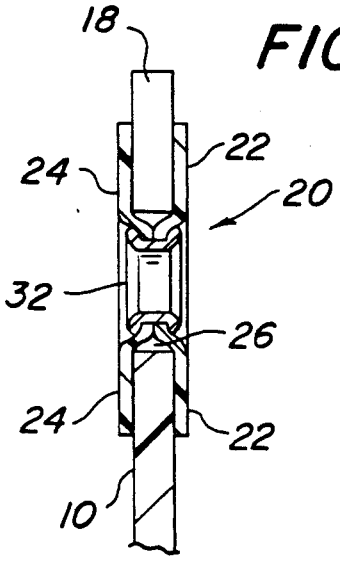
FIG. 7
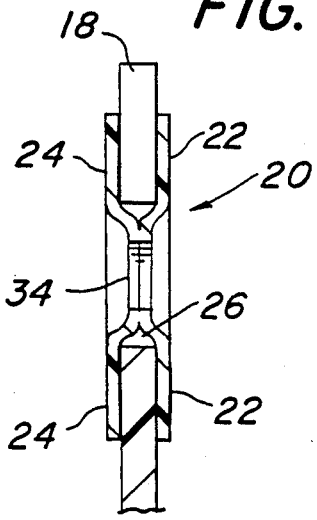

FIG. 8
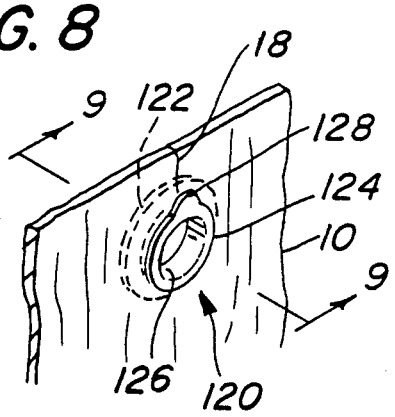
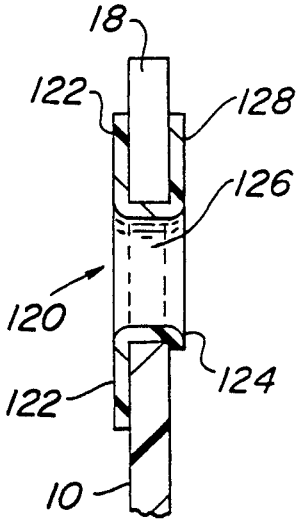
FIG. 9
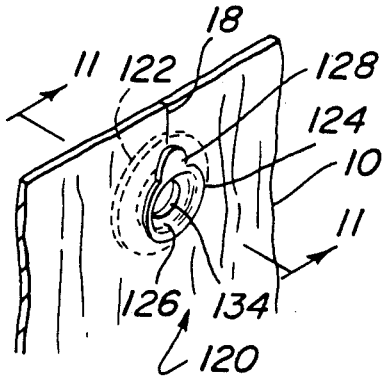
FIG. 10
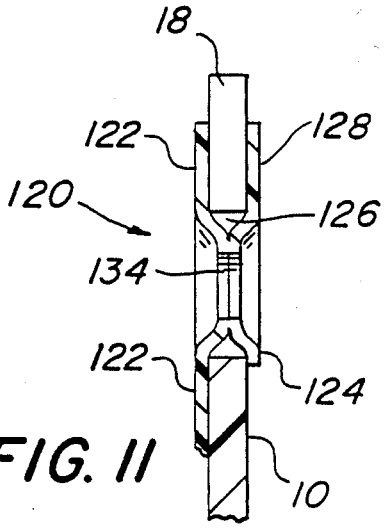
FIG. 11

REPAIR KIT FOR SHOWER CURTAIN AND THE LIKE

Background of the Invention

The present invention resides in the field of reinforcing and repairing plasticized sheeting materials having apertures at or closely adjacent their tops for suspending the sheeting materials from a suspension means, i.e. a rod or other rigid suspension means.

In recent years the use of plasticized sheeting materials in shower curtains and liners, bathroom curtains, and the like has substantially increased. In proportionate number these items have to be discarded when one or more of the apertures tear through to the top of the sheeting materials from repeated normal, or abusive, use leaving each aperture in a non-supporting state. The result of this tearing is to cause a shower curtain, liner, etc. which sags at the tear, looking unseemly, and further deterioration, by tearing or otherwise, by added weight on the other apertures.

Several attempts have been made to alleviate or circumvent the tearing of the plasticized sheet material by reinforcing the sheet material. One such attempt has been to apply a reinforcing pattern into the sheet material at a location surrounding the apertures by heat welding the pattern into the material. Other attempts have included placing a stiffener or a reinforcing piece of similar sheeting material within a fold at the top of the shower curtain or the like. See U.S. Pat. No. 2,855,040 entitled Curtain Having Supporting Eyelets Formed Therein as an example of the method of heat welding a reinforcing pattern into plasticized sheet material. Still other attempts have been made to alleviate the tearing, such as by placing fabric material over the plasticized sheeting material and increasing the diameter of the supporting hanger such that an increased surface area is presented to reduce the chance of a tear originating from the hanger.

There still remains, however, the problem of repairing a tear when one occurs either from accident or misuse. Linked to this problem is the cost of replacing one member of a set of bath curtains, or a favorite curtain, which may not be readily matched.

It is therefore an object of the present invention to provide a reinforcing means for repairing tears in plasticized sheet materials in order to render them again serviceable.

It is a further object of the present invention to provide a kit for repairing a number of tears in plasticized sheet materials and/or reinforce apertures from which the sheet materials are suspended.

It is another object of the present invention to provide either transparent or color co-ordinated reinforcing means to closely approach or match the decoration on the sheet material making the reinforcing means more acceptable to discriminating decorators.

Other objects will appear hereinafter.

Summary of the Invention

The present invention comprises a substantially circular, thin, pliable reinforcing means, manipulatable as a unit, having disc-like members of uniform diameter with inner and outer surfaces disposed on each side of a ring shaped central member. A centrally located hole extends through each of the members, the disc-like and the ring shaped central members, with each of the centrally located holes axially aligned one with the others.

The reinforcing means is for use in repairing tears in sheet material having one or more apertures located adjacent the top of said sheet material. The apertures are used to suspend the sheet material from a suspension means using one or more hangers for connecting the suspension means to the sheet material at the apertures. The reinforcing means of the present invention is applied by inserting said reinforcing means through the sheet material at one or more of said apertures and adjacent a tear such that the inner surfaces of each disc-like member lie in close juxtaposition over the sheet material surrounding the one or more apertures and are affixed thereupon.

The present invention additionally provides for differing structures of the reinforcing means, unitized construction and unitized construction with a heat weld or a metallized rivet disposed within the centrally located hole of the ring shaped central member. Each of the species of reinforcing means are preferred to be manufactured from an elastomeric-type material exhibiting certain characteristics, e.g., flexibility or pliability.

A second embodiment of the invention provides for the elimination of one disc-like member on the side of the sheet material facing inward to the bath structure, window, etc. and substitutes therefor an annular ring with an integrally attached tab. The tab is to be affixed directly over the tear on the inward facing side of the sheet material in order to provide added strength to the repaired area of the sheet material.

Additionally, the present invention may be transparent or have a color to co-ordinate with the decorative scheme in the sheet material. An adhesive, of the cold bonding type, is affixed to the inner surfaces of the disc-like members of the reinforcing means, either by pre-application or by application at the time of repair. If the adhesive is pre-applied, a thin removable sheet should be applied over the adhesive to preserve the adhesive in a usable state and to prevent unwanted attachment prior to permanent placement.

Brief Description of the Drawings

For the purpose of illustrating the invention, there are shown in the drawings forms which are presently preferred; it being understood, however, that the invention is not limited to the precise arrangement and instrumentalities shown.

FIG. 4 is a fragmentary isometric view of the first embodiment of the reinforcing means of the present invention mounted to a dispensing means.

FIG. 5 is a cross-sectional view of FIG. 3 taken along line 5—5.

FIG. 6 is an alternate embodiment of the first embodiment of the reinforcing means of the present invention with a metallized insert.

FIG. 7 is another alternate embodiment of the first embodiment of the reinforcing means of the present invention with a heat weld.

FIG. 8 is a fragmentary isometric view of a second embodiment of the reinforcing means of the present invention.

FIG. 9 is a cross-sectional view of FIG. 8 taken along line 9—9.

FIG. 10 is a fragmentary isometric view of an alternate embodiment of the second embodiment of the reinforcing means of the present invention with a heat weld.

FIG. 11 is a cross-sectional view of FIG. 10 taken along line 11—11.

Detailed Description of the Invention

The following detailed description is of the best presently contemplated modes of carrying out the present invention. This description is not intended in a limiting sense, but is made solely for the purpose of illustrating the general principles of the invention.

Figure 1:
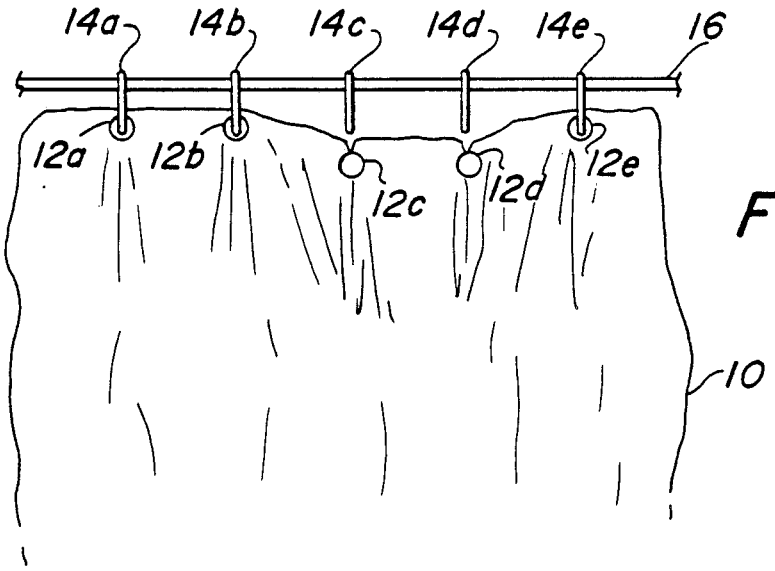
FIG. 1 is a partial front elevational view of a damaged or torn shower curtain.

Referring now to the drawings in detail, wherein like numerals represent like elements, there is shown a plasticized shower curtain 10 having several apertures or eyelet holes 12*a*–12*e* adjacent the top thereof. The shower curtain 10 is suspended by hangers 14*a*–*14e* from a rod or suspension means 16 located above the curtain. FIG. 1 shows two tears in the shower curtain 10 adjacent apertures 12*c* and 12*d*. The shower curtain 10 sags unsupported below a line parallel to the suspension means 16 along which the curtain remains supported by the hangers 14*a*, 14*b*, and 14*e*. The sagging of the shower curtain 10 causes added stress on closely adjacent apertures due to a redistribution of the weight of the curtain to the remaining intact apertures. An additional problem which may be encountered is the hangers 14*c* and 14*d*, unfettered by the corresponding aperture of the curtain, may now impede the movement of the shower curtain 10 in opening and closing. The impediment to free movement by the hangers may, in turn, cause additional damage to the shower curtain 10 through tears at closely adjacent apertures because of increased stress at those locations.

Figure 2:
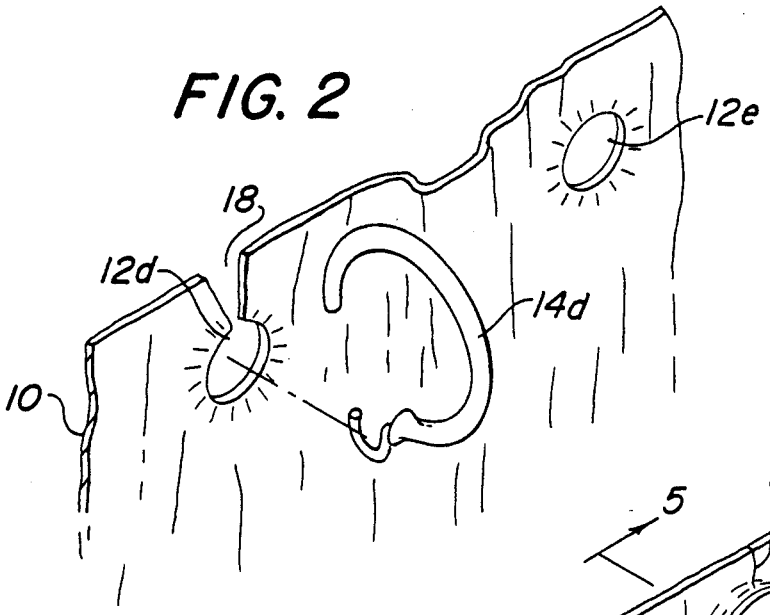
FIG. 2 is a partial exploded isometric view of FIG. 1 with a shower curtain hanger.

Referring to FIG. 2 an enlarged view of the shower curtain 10 of FIG. 1 shows the apertures 12*d* and 12*e* with a tear in the sheet material adjacent aperture 12*d*. Hanger 14*d* is also shown exploded apart from the corresponding aperture. Surrounding each of the apertures, 12*d* and 12*e*, a heat welded reinforcing pattern is intended to be shown, indicated by the outwardly radiating lines. The tear 18 extends downward from the top of the shower curtain 10 to the aperture 12*d*. Both the tear 18 and the thickness of the shower curtain 10 are accentuated. The tear 18 may not be as pronounced in actuality. The thickness of the sheet material of the shower curtain 10 is approximately 1/64 of an inch or less.

Figure 3:
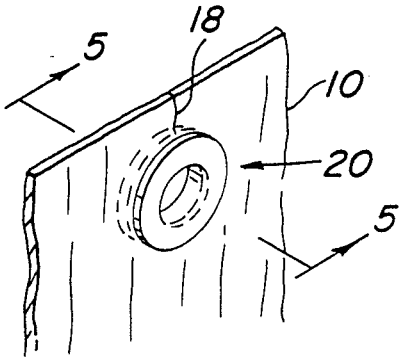
FIG. 3 is a cross-sectional view of a repaired shower curtain as shown in FIG. 2 using the first embodiment of the reinforcing means of the present invention.

With reference to FIGS. 3, 4 and 5, the reinforcing means of the present invention 20 is described as follows. The first embodiment of the reinforcing means 20 is comprised of two disc-like members 22, 24 disposed on each side of a ring shaped central member 26. Each of the disc-like members 22, 24 and the ring shaped central member 26 have axially aligned centrally located holes extending therethrough to accommodate the distending supporting appendage of any of the hangers 14*a*–14*e*. diameter of each of the disc-like members 22, 24 is uniform and of a dimension which is preferred to completely cover any heat welded reinforcing pattern in the underlying sheet material of the shower curtain 10.

Referring to FIGS. 3 and 5, the first embodiment of the reinforcing means 20 of the present invention is applied to the shower curtain 10 by inserting the reinforcing means 20 into the aperture (12*a*–12*e*), if the tear 18 is large, or through the aperture (12*a*–12*e*), by compressing one of the disc-like members 22, 24 and inserting the compressed disc-like member through the aperture. Once the disc-like members 22, 24 of the reinforcing means 20 are disposed on both sides of the shower curtain 10, the reinforcing means 20 may be aligned over the aperture adjacent the tear 18 and the sheet material of the shower curtain 10 on both sides of the tear 18 brought together. FIG. 5 specifically shows the disc-like members 22, 24 of the reinforcing means 20 overlying the sheet material of the shower curtain 10 in the lower part of the drawing and juxtaposed to the tear 18 in the upper part of the drawing. FIG. 3 shows the reinforcing means 20 aligned over the aperture and sheet material of the shower curtain 10 repairing the tear 18 and reinforcing the shower curtain 10 against future tearing at the same location.

The reinforcing means 20, once located and aligned over the aperture and underlying sheet material of the shower curtain 10, can be affixed to the exterior surfaces of the shower curtain 10. The interior surfaces of each of the disc-like members 22, 24 are adhered to the exterior surfaces of the shower curtain 10 underlying the reinforcing means 20 by any cold bonding adhesive, which is presently known or later discovered, and which sets in a relatively short period of time after placement. The adhesive may be in liquid form and applied to the juxtaposed surfaces by an applicator. The adhesive may also be in solid form and applied to the interior surfaces of the disc-like members 22, 24 of the reinforcing means 20. A thin paper shield which does not react with the adhesive covers the adhesive to keep the reinforcing means 20 from becoming adhered to the underlying sheet material of the shower curtain before being properly aligned. FIG. 4 shows the reinforcing means 20 mounted on dispensing sheets 28, 30. When using a solid or paste adhesive applied to the interior surface of the disc-like members 22, 24, the reinforcing means 20 should be mounted on the dispensing sheets 28, 30 to preserve the adhesive and keep the reinforcing means from improperly adhering to the wrong surface. The dispensing sheets 28, 30 may be torn or cut apart in order that a single reinforcing means 20 can be applied to the area of a tear.

FIGS. 6 and 7 are alternate embodiments of the first embodiment of the reinforcing means 20 of the present invention. The reinforcing means 20 shown in FIG. 6 has a metallized rivet 32 with a central bore disposed within the centrally located hole of the ring shaped central member 26 which clamps over extensions of the disc-like members 22, 24 projecting inwardly into the centrally located hole. The metallized rivet 32, while reducing the size of the centrally located hole in the reinforcing means 20, increases the strength of the repair through the use of metal as a reinforcement against further tearing of the sheet material of the shower curtain 10.

FIG. 7 shows the reinforcing means 20 of the present invention with a heat welded collar 34, also having a central bore therethrough, disposed within the centrally located hole of the ring shaped central member 26. The heat welded collar 34 connects inwardly protruding extensions of the disc-like members 22, 24 to give additional reinforcement characteristics to the reinforcing means 20. Although the heat welded collar 34 also decreases the size of the centrally located hole through which the distending appendage of the hanger is placed, this decrease in size is offset by the increase in reinforcement against further tearing of the sheet material of the shower curtain 10.

A second embodiment of the reinforcing means 120 of the present invention is shown in FIGS. 8 and 9. The reinforcing means 120 has one disc-like member 122 on the proximal side of the sheet material of the shower curtain 10 disposed identically to the disc-like member 22 described above. However, on the distal side of the sheet material of the shower curtain 10, (the side facing inward to the bath structure) the disc-like member is replaced by an annular ring 124 surrounding the ring shaped central member 126. As in the first embodiment of the reinforcing means 20 of the present invention, this reinforcing means 120 has a centrally located hole through each of the elements, the disclike member 122, the annular ring 124, and the ring shaped central member 126. These elements have axially aligned centrally located holes extending therethrough to accommodate the distending supporting appendage of any of the hangers **14*a*–14*e*. The diameter of the disc-like member 122 is uniform and of a dimension which is preferred to completely cover any heat welded reinforcing pattern in the underlying sheet material of the shower curtain 10**.

The diameter of the annular ring 124 is also uniform and extends outward only to provide a securing lip on the distal side of the sheet material of the shower curtain 10. Attached to the annular ring 124 is a tab 128 which extends outward from the annular ring 124 a distance equivalent to the diameter of the disc-like member 122. The tab 128 is applied over the tear 18 repairing the tear and providing additional reinforcement to that area of the sheet material of the shower curtain 10.

Referring to FIGS. 10 and 11, an alternate embodiment of the second embodiment of the reinforcing means 120 of the present invention is shown. As in FIG. 8, the reinforcing means 120 is shown mounted on the sheet material of the shower curtain 10 in repair of the tear 18. The view of the shower curtain 10 is from the rear, as in FIG. 8, such that the disc-like member 122 is shown in phantom on the proximal side of the shower curtain 10. On the distal side of the shower curtain 10 the annular ring 124 and the tab 128 overlaying the tear 18 appear. Extending through the shower curtain 10 is the ring shaped central member 126. Each of these elements has an axially aligned centrally located hole extending therethrough such that the distending appendage of the hangers **14*a* –14*e* may pass through and support the shower curtain 10. This alternate embodiment of the reinforcing means 120 also has a heat welded collar 134 disposed within the centrally located hole of the ring shaped central member 126 with a central bore extending therethrough. The heat welded collar 134 connects inwardly protruding extensions of the disc-like member 122 and the annular ring 124 to give additional reinforcement characteristics to the reinforcing means 120. Although the heat welded collar 134 decreases the size of the annular hole through which the distending appendage of the hanger is placed, this decrease in size is offset by the increase in reinforcement against further tearing of the sheet material of the shower curtain 10**.

The second embodiment of the reinforcing means 120 is somewhat easier to align over the tear 18. The distal or tab side of the reinforcing means 120 is inserted through the aperture, or along the tear line and located over the appropriate opening in the shower curtain 10. The reinforcing means 120, once located and aligned over the aperture and underlying sheet material of the shower curtain 10, can be affixed to the exterior surfaces of the shower curtain 10. The interior surfaces of the disc-like member 122, the annular ring 124, and the tab 128 can be adhered to the exterior surfaces of the shower curtain 10 underlying these elements of the reinforcing means 120 by any cold bonding adhesive, which is presently known or later discovered, and which sets in a short time period. Alignment of the reinforcing means for this second embodiment of the reinforcing means 120 requires the placement of the tab over the tear 18. As in the case of the first embodiment, a liquid adhesive or an adhesive paste may be applied to the shower curtain 10 or the reinforcing means 120, respectively, as described in connection with the description of the adhering of the reinforcing means 20 to the underlying sheet material of the shower curtain 10 above.

As is clearly evident from the sectional views of FIGS. 5, 6, 7, 9, and 11, the inner circumferences of the centrally disposed hole in each of the disc members 22, 24 of the first embodiment, and the disc member 122 and the annular ring 124 of the second embodiment, are similarly sized and aligned (or in registry with) the centrally disposed hole of the opposing disc member or annular ring. Also having a similarly sized central bore are the ring shaped members 26, 126 which are used to join the disc members 22, 24 of the first embodiment, and the disc member 122 and annular ring 124 of the second embodiment, one to the other. Thus, there is created a uniform path through the repair and reinforcing means 20, 120 of the present invention for passage of the hangers **14*a*–14*e*** as shown in the various drawing figures accompanying this written description.

In each of the drawing figures the thickness dimension of the sheet material of the shower curtain 10 and the ring shaped central members 26 and 126 have been exaggerated so that the invention can be properly shown without loss of detail. Other element dimensions in the drawing figures have been altered proportionately to conform with the exaggeration of the thickness. In actuality, the thickness of the sheet material of the shower curtain approximates 1/32 of an inch, or less, as does the thickness of the disc-like members 22, 24 and 122 and the annular ring 124 of the reinforcing means 20, 120.

Either of the two embodiments can be manufactured from currently known or later discovered elastomeric materials, such as plastics, vinyls and the like. The reinforcing means 20, 120 requires that they be sufficiently flexible or pliable to be inserted through the aperture of the shower curtain without further tearing of the sheet material and be able to be adhered to a plasticized or fabric surface of the sheet material of the shower curtain, or other plasticized or fabric sheet materials.

The present invention provides a simple means to repair and reinforce a tear in the sheet material of a shower curtain and the like without the need to replace the entire curtain. In order to satisfy the decorative aspects of shower curtains, and similar types of articles, the present invention can be transparent or color coordinated to the principle color scheme of the article upon which it is to be applied. Of course, the same color or different color reinforcing means may be used on the same article to repair and reinforce each of the apertures. This may provide a change in the decorative scheme of the article, or keep the scheme unchanged, depending only upon the desire of the individual using the reinforcing means.

The present invention may be embodied in other specific forms without departing from the spirit or essential attributes thereof and, accordingly, reference should be made to the appended claims, rather than to the foregoing specification, as indicating the scope of the invention.

I claim:

1. A repair and reinforcing means for use in repairing tears in sheet material or reinforcing said sheet material about one or more apertures located adjacent the top edge of said sheet material, said apertures being used to suspend said sheet material from a suspension means using one or more hangers connecting the suspension means to the sheet material at said apertures, said repair and reinforcing means comprising substantially circular, thin, pliable disc members of uniform diameter having inner and outer surfaces and a centrally located hole through each disc member, each said disc member extends inwardly a uniform distance into the centrally located hole and is clamped one to the other by a rivet having a central bore forming a manipulatable reinforcing unit for insertion through one of said apertures in the sheet material adjacent a tear such that the inner surface of each disc member lies in proximate juxtaposition over the sheet material surrounding and defining said apertures and bonding means for adherence of said inner surface of each disc member to the overlaid outer surface of the sheet material.

2. A repair and reinforcing means in accordance with claim 1 wherein said reinforcing means is made from an elastomeric material, natural or man-made, having sufficient pliability to be deformed and to regain its original configuration.

3. A repair and reinforcing means in accordance with claim 1 wherein said reinforcing means may be transparent or opaque exhibiting none or one or more colors.

4. A repair and reinforcing means for use in repairing tears in sheet material or reinforcing said sheet material about one or more apertures located adjacent the top edge of said sheet material, said apertures being used to suspend said sheet material from a suspension means using one or more hangers connecting the suspension means to the sheet material at said apertures, said repair and reinforcing means comprising a substantially circular, thin, pliable disc member of uniform diameter having inner and outer surfaces and a centrally located hole disposed through said disc member, an annular ring having a central bore sized similarly to and in registry with the hole in said disc member and a tab extending radially outward from the periphery of said annular ring, said disc member and said annular ring and outwardly extending tab being attached to and on either side of a ring shaped central member to form a manipulatable reinforcing unit for insertion through one of said apertures in the sheet material adjacent a tear such that the inner surface of the disc member lies in proximate juxtaposition over the sheet material surrounding and defining said one of said apertures on a first side of said sheet material and the inner surface of said annular ring and outwardly extending tab lie in proximate juxtaposition over the sheet material surrounding and defining the same said one of said apertures on the opposing side of said sheet material, and bonding means for adherence of said inner surfaces of said disc member and said annular ring and outwardly extending tab to the overlaid outer surfaces of said first and opposing sides of said sheet material.

5. A repair and reinforcing means in accordance with claim 4 wherein the disc member and the annular ring extend inwardly a uniform distance into the centrally located hole and the disc member and annular ring are clamped one to the other by a rivet having a central bore.

6. A repair and reinforcing means in accordance with claim 4 wherein the disc member and the annular ring extend inwardly a uniform distance into the centrally located hole and the disc member and the annular ring are clamped one to the other along their opposing inner edges by a heat weld.

7. A repair and reinforcing means in accordance with claim 4 wherein said reinforcing means is made from an elastomeric material, natural or man-made, having sufficient pliability to be deformed and to regain its original configuration.

8. A repair and reinforcing means in accordance with claim 4 wherein said reinforcing means may be transparent or opaque exhibiting none or one or more colors.

* * * * *